US006036019A

United States Patent [19]

Silverman

[11] Patent Number: 6,036,019

[45] Date of Patent: Mar. 14, 2000

[54] BABY FOOD CONTAINER

[76] Inventor: William A. Silverman, 24 Kleggstone Cir., Bloomington, Ill. 61704

[21] Appl. No.: 09/074,149

[22] Filed: May 7, 1998

[51] Int. Cl.[7] ..... A45C 11/20

[52] U.S. Cl. ..... 206/545; 206/523; 206/478

[58] Field of Search ..... 206/545, 523, 206/348, 478, 479; 220/694, 735

[56] References Cited

U.S. PATENT DOCUMENTS

| | | | |
|---|---|---|---|
| 2,228,493 | 1/1941 | Will | 206/523 |
| 2,496,296 | 2/1950 | Lobl | 206/478 |
| 3,591,768 | 7/1971 | Torres | 206/478 |
| 4,106,597 | 8/1978 | Shook et al. | 190/42 |
| 4,620,579 | 11/1986 | Lowe et al. | 206/523 |
| 4,763,791 | 8/1988 | Halverson et al. | 206/570 |
| 5,040,678 | 8/1991 | Lenmark, Sr. et al. | 206/443 |
| 5,207,303 | 5/1993 | Oswalt et al. | 190/108 |
| 5,316,178 | 5/1994 | Garber, Jr. | 206/523 |
| 5,320,223 | 6/1994 | Allen | 206/372 |
| 5,397,875 | 3/1995 | Bechtold, Jr. | 219/521 |
| 5,529,184 | 6/1996 | Sadow | 206/320 |
| 5,786,011 | 7/1998 | Desjardins | 206/523 |
| 5,799,791 | 9/1998 | Harley | 206/478 |

*Primary Examiner*—Paul T. Sewell
*Assistant Examiner*—Nhan T. Lam

[57] ABSTRACT

A baby food containment box is provided including a base for containing baby food. Also included is a lid removably coupled to the base. A pair of straps are provided for containing a bib within the box. Further, the base has a foam block removably situated therein with a plurality of recesses formed in a top face thereof for containing various items.

1 Claim, 1 Drawing Sheet

BABY FOOD CONTAINER

BACKGROUND OF THE INVENTION

1. Field of the Invention

The present invention relates to containers for storing items for a small child and more particularly pertains to a new baby food container for storing baby food and eating utensils.

2. Description of the Prior Art

The use of containers for storing items for a small child is known in the prior art. More specifically, containers for storing items for a small child heretofore devised and utilized are known to consist basically of familiar, expected and obvious structural configurations, notwithstanding the myriad of designs encompassed by the crowded prior art which have been developed for the fulfillment of countless objectives and requirements.

Known prior art containers for storing items for a small child include U.S. Pat. No. 5,188,234; U.S. Pat. No. 5,082,115; U.S. Pat. Des. 354,655; U.S. Pat. No. 4,947,993; U.S. Pat. No. 5,427,292; and U.S. Pat. No. 5,322,182.

In these respects, the baby food container according to the present invention substantially departs from the conventional concepts and designs of the prior art, and in so doing provides an apparatus primarily developed for the purpose of storing baby food and eating utensils.

SUMMARY OF THE INVENTION

In view of the foregoing disadvantages inherent in the known types of containers for storing items for a small child now present in the prior art, the present invention provides a new baby food container construction wherein the same can be utilized for storing baby food and eating utensils.

The general purpose of the present invention, which will be described subsequently in greater detail, is to provide a new baby food container apparatus and method which has many of the advantages of the containers for storing items for a small child mentioned heretofore and many novel features that result in a new baby food container which is not anticipated, rendered obvious, suggested, or even implied by any of the prior art containers for storing items for a small child, either alone or in any combination thereof.

To attain this, the present invention generally comprises a base having a rectangular bottom face and a side wall integrally coupled to a periphery of the bottom face and extending upwardly therefrom. The side wall of the base is adapted for defining an interior space and an upper peripheral edge. The side wall of the base is defined by a front face, a rear face and a pair of side faces. The base further includes a horizontally oriented top face level with the upper peripheral edge of the side wall with a plurality of recesses formed therein. The recesses include four vertically oriented cylindrical recesses situated adjacent to each of four corners of the top face. The cylindrical recesses are adapted for releasably receiving bottles of baby food. The recesses further include an elongated rectangular utensil recess formed along a central extent of the top face between the side faces. A pair of elongated upper edges of the utensil recess each include a semi-circular cut out formed in a central extent thereof. FIG. 1 shows a lid with a rectangular top face and a side wall integrally coupled to a periphery of the top face of the lid and extending downwardly therefrom. The side wall of the lid thus defines an interior space, an open bottom and a lower peripheral edge. The side wall of the lid is defined by a front face, a rear face and a pair of side faces. A lower edge of the lid is removably coupled to an upper edge of the base. A pair of flexible straps are provided each having an inboard end coupled to a bottom surface of the top face of the lid. Each of the straps extend downwardly from the lid and terminate in a free outboard end. The outboard end of each strap is equipped with a pile fastener mounted thereon for coupling a rolled bib to the lid.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new baby food container apparatus and method which has many of the advantages of the containers for storing items for a small child mentioned heretofore and many novel features that result in a new baby food container which is not anticipated, rendered obvious, suggested, or even implied by any of the prior art containers for storing items for a small child, either alone or in any combination thereof.

It is another object of the present invention to provide a new baby food container which may be easily and efficiently manufactured and marketed.

It is a further object of the present invention to provide a new baby food container which is of a durable and reliable construction.

An even further object of the present invention is to provide a new baby food container which is susceptible of a low cost of manufacture with regard to both materials and labor, and which accordingly is then susceptible of low prices of sale to the consuming public, thereby making such baby food container economically available to the buying public.

Still yet another object of the present invention is to provide a new baby food container which provides in the apparatuses and methods of the prior art some of the advantages thereof, while simultaneously overcoming some of the disadvantages normally associated therewith.

Still another object of the present invention is to provide a new baby food container for storing baby food and eating utensils.

Even still another object of the present invention is to provide a new baby food container that includes a base for containing baby food. Also included is a lid removably coupled to the base. A pair of straps are provided for containing a bib within the box. Further, the base has a foam block removably situated therein with a plurality of recesses formed in a top face thereof for containing the baby food.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2:
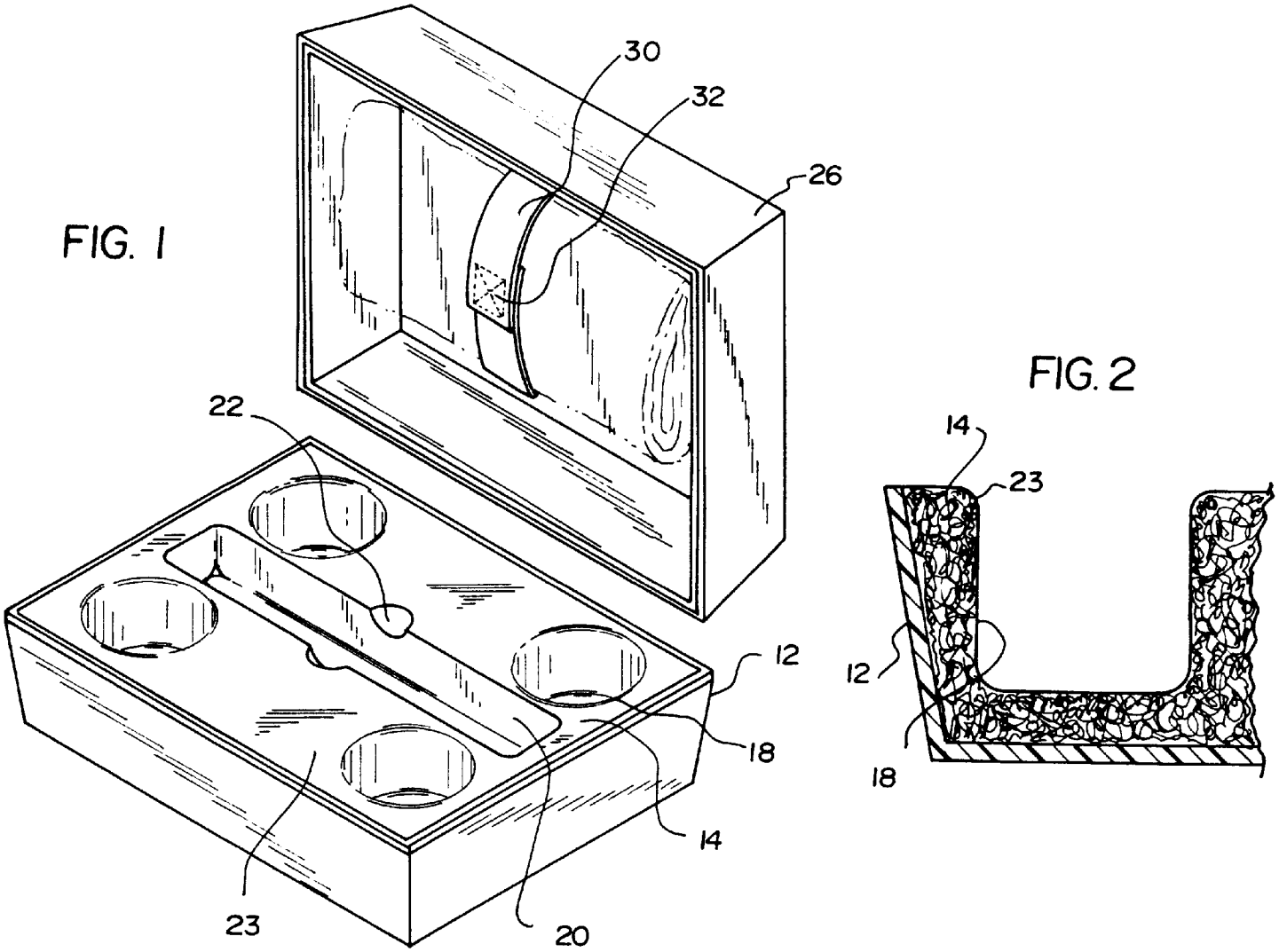
FIG. 1 is a perspective view of a new baby food container according to the present invention.
FIG. 2 is a side cross-sectional view of one of the cylindrical recesses of the present invention.

With reference now to the drawings, and in particular to FIGS. 1 through 2 thereof, a new baby food container embodying the principles and concepts of the present invention and generally designated by the reference numeral 10 will be described.

The present invention, designated as numeral 10, is preferably constructed from recycled plastic. As shown in the Figures, the present invention includes a base 12 having a rectangular bottom face and a side wall integrally coupled to a periphery of the bottom face and extending upwardly therefrom. The side wall of the base is thus adapted for defining an interior space and an upper peripheral edge. The side wall of the base is formed of a front face, a rear face and a pair of side faces.

The base further includes a horizontally oriented top face 14 being situated level with the upper peripheral edge of the side wall with a plurality of recesses formed therein. The recesses include four vertically oriented cylindrical recesses 18 situated adjacent to each of four corners of the top face. The cylindrical recesses are adapted for releasably receiving bottles of baby food. Ideally, the cylindrical recesses each have a depth about equal to that of the base. The recesses further include an elongated rectangular utensil recess 20 formed along a central extent of the top face between the side faces. A depth of the utensil recess is preferably about ½ that of the cylindrical recesses. A pair of elongated upper edges of the utensil recess each include a semi-circular cut out 22 formed in a central extent thereof for facilitating the removal of utensils.

For maintaining a temperature of the baby food constant, the top face is preferably a component of a slightly deformable, resilient foam block 23 which is sized and shaped to be frictionally situated within the interior space of the base, as shown in FIG. 2. By use of the deformable block, the recesses are adapted to securely fit about the jars of baby food. In the preferred embodiment the block is removably coupled to the base for washing purposes.

FIG. 1 shows a lid 26 with a rectangular top face and a side wall integrally coupled to a periphery of the top face of the lid and extending downwardly therefrom. The side wall of the lid thus defines an interior space, an open bottom and a lower peripheral edge. The side wall of the lid is defined by a front face, a rear face and a pair of side faces. As shown in FIG. 1, the side walls of the lid and base have equal heights.

The lid has a lower edge removably coupled to an upper edge of the base. In the preferred embodiment, the lid has a peripheral groove formed therein for sealingly coupling with the base.

A pair of flexible straps 30 are provided each having an inboard end coupled to a bottom surface of the top face of the lid. Each of the straps extend downwardly from the lid and terminate in a free outboard end. The outboard end of each strap is equipped with a pile fastener 32 mounted thereon for coupling a rolled bib to the lid. It should be noted that the present invention is of a size small enough to fit within a diaper bag.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A baby food containment box comprising, in combination:

a base including a rectangular bottom face, a side wall integrally coupled to a periphery of the bottom face and extending upwardly therefrom for defining an interior space and an upper peripheral edge, the side wall of the base defined by a front face, a rear face and a pair of side faces, the base further including a resiliently deformable foam block frictionally situated within the interior space of the base, the foam block having a horizontally oriented insulated top face level with the upper peripheral edge of the side wall and a plurality of recesses formed therein each adapted for frictionally receiving a baby food jar therein, the recesses include four vertically oriented substantially cylindrical recesses situated adjacent to each of four corners of the top face for releasably receiving bottles of baby food and an elongated rectangular utensil recess formed along a central extent of the top face between the side faces, the utensil recess further having a pair of elongated upper edges which each include a semi-circular cut out formed in a central extent thereof, the foam block being for maintaining a temperature of the baby food;

the side wall of the base tapering outwardly from the bottom face to the upper peripheral edge of the base such that a width of a portion of the resiliently deformable foam block positioned between the substantially cylindrical recesses and the side wall is wider towards the tipper peripheral edge of the base than towards the bottom face of the base, the tapering of the side wall of the base being for permitting easier insertion of baby food jars in the substantially cylindrical recesses;

the utensil recess having opposite first and second ends, the first end of the utensil recess being positioned between a first pair of cylindrical recesses, the second end of the utensil recess being positioned between a second pair of cylindrical recesses, wherein a depth of the utensil recess is about ½ the depth of the cylindrical recesses for reducing the amount of movement of utensils held therein during movement of the base for helping reduce damage to the utensils;

a lid including a rectangular top face and a side wall integrally coupled to a periphery of the top face of the lid and extending downwardly therefrom for defining an interior space, an open bottom and a lower peripheral edge, the side wall of the lid defined by a front face, a rear face and a pair of side faces, a lower edge of the lid being coupled to an upper edge of the base;

the lid having a peripheral groove formed therein for sealingly coupling with the base;

wherein the side wall of the lid has substantially the same dimensions as the side wall of the base;

a pair of flexible straps each having an inboard end coupled to a bottom surface of the top face of the lid and extending downwardly therefrom, the straps each having an outboard end with a pile fastener mounted thereon; and a bib being folded, the straps removably coupling the bib to the bottom surface of the top face of the lid.

* * * * *